US005993698A

United States Patent [19]

Frentzel et al.

[11] Patent Number: 5,993,698

[45] Date of Patent: Nov. 30, 1999

[54] ELECTRICAL DEVICE CONTAINING POSITIVE TEMPERATURE COEFFICIENT RESISTOR COMPOSITION AND METHOD OF MANUFACTURING THE DEVICE

[75] Inventors: Richard Lee Frentzel, Chino Hills; Richard E. Bowns, Hacienda Heights; Michael Kevin Munoz, Hesperia; Scott Timon Allen, Baldwin Park, all of Calif.

[73] Assignee: Acheson Industries, Inc., Port Huron, Mich.

[21] Appl. No.: 09/186,670

[22] Filed: Nov. 5, 1998

Related U.S. Application Data

[60] Provisional application No. 60/064,660, Nov. 6, 1997.

[51] Int. Cl.[6] ..... H01B 1/06; H01B 1/02

[52] U.S. Cl. ..... 252/511; 252/512; 252/513; 252/514; 338/22 R; 338/214; 427/58; 427/101

[58] Field of Search ..... 252/511–514, 519.33; 427/58, 101; 338/22 R, 25, 214

[56] References Cited

U.S. PATENT DOCUMENTS

| | | | |
|---|---|---|---|
| 4,545,926 | 10/1985 | Fouts et al. | 252/511 |
| 4,560,498 | 12/1985 | Horsma et al. | 252/511 |
| 4,658,121 | 4/1987 | Horsma et al. | 219/553 |
| 5,304,326 | 4/1994 | Goto et al. | 252/511 |

*Primary Examiner*—Yogendra Gupta
*Assistant Examiner*—Derrick G. Hamlin
*Attorney, Agent, or Firm*—Dinnin & Dunn, P.C.

[57] ABSTRACT

A positive temperature coefficient (PTC) resistor composition, comprising: (a) about 3% to about 75% by weight of a binder resin, (b) about 0.5% to about 70% by weight of a temperature activatable semicrystalline polymer, which is a thermoplastic elastomer (TPE) that melts at a relatively narrow temperature range to change from a crystalline state to an amorphous state, (c) about 10% to about 80% by weight of an electrically conductive material in finely particulated form selected from the group consisting of silver, graphite, graphite/carbon, nickel, copper, silver coated copper, and aluminum, (d) about 0.01% to about 80% by weight of solvent material for the composition.

18 Claims, 4 Drawing Sheets

ELECTRICAL DEVICE CONTAINING POSITIVE TEMPERATURE COEFFICIENT RESISTOR COMPOSITION AND METHOD OF MANUFACTURING THE DEVICE

This application is a continuation-in-part of U.S. provisional Application Ser. No. 60/064,660, filed Nov. 6, 1997.

The state of the prior art is indicated in the following U.S. patents: Shafe et al. U.S. Pat. No. 5,093,036; Sherman et al. U.S. Pat. No. 4,910,389; Kim et al. U.S. Pat. No. 5,556,576; and, Tsubokawa et al. U.S. Pat. No. 5,374,379.

BACKGROUND OF THE INVENTION

This invention broadly relates to electrical devices which contain or include a new positive temperature coefficient resistor (PTCR) composition and the method of manufacturing such devices, as well as the method of preparing such positive temperature coefficient resistor compositions. Such compositions are highly useful for screen printing, for preparation of printed circuits, and for the preparation of numerous different types of electrical devices, as will be discussed hereinafter.

These prior patents involve mixing carbon/graphite with a semi-crystalline polymer which is dissolved in a strong solvent or extruded; or grafting graphite onto a semi-crystalline polymer. The disadvantages to the dissolution approach are that the polymers have poor physical properties and the strong solvents cannot be used in screen printing due to the fact that they will attack the screen emulsion.

SUMMARY OF THE INVENTION

From a composition standpoint, the inventive discovery herein involves a positive temperature coefficient (PTC) resistor composition, comprising: (a) about 3% to about 75% by weight of a binder resin, (b) about 0.5% to about 70% by weight of a temperature activatable semicrystalline polymer, which is a thermoplastic elastomer (TPE) that melts at a relatively narrow temperature range to change from a crystalline state to an amorphous state, (c) about 10% to about 80% by weight of an electrically conductive material in finely particulated form selected from the group consisting of silver, graphite, graphite/carbon, nickel, copper, silver coated copper, and aluminum, (d) about 0.01% to about 80% by weight of solvent material for the composition.

In another aspect, the invention involves an electrical device made from a PTC resistor composition, comprised of, (a) about 3% to about 75% by weight of a binder resin, (b) about 0.5% to about 70% by weight of a temperature activatable semicrystalline polymer, which is a thermoplastic elastomer (TPE) that melts at a relatively narrow temperature range to change from a crystalline state to an amorphous state, (c) about 10% to about 80% by weight of an electrically conductive material in finely particulated form selected from the group consisting of silver, graphite, graphite/carbon, nickel, copper, silver coated copper, and aluminum, (d) about 0.01% to about 80% by weight of solvent material for the composition, and wherein said PTC resistor composition is applied to at least one substrate surface within said electrical device, and said device includes at least one electrical circuit for conducting electricity within said device.

From a method aspect, the invention involves a method of manufacturing an electrical device comprising the steps of, (1) providing a PTC resistor composition comprised of, (a) about 3% to about 75% by weight of a binder resin, (b) about 0.5% to about 70% by weight of a temperature activatable semicrystalline polymer, which is a thermoplastic elastomer (TPE) that melts at a relatively narrow temperature range to change from a crystalline state to an amorphous state, (c) about 10% to about 80% by weight of an electrically conductive material in finely particulated form selected from the group consisting of silver, graphite, graphite/carbon, nickel, copper, silver coated copper, and aluminum, (d) about 0.01% to about 80% by weight of solvent material for the composition, and (2) applying said PTC resistor composition to a substrate which is a part of said electrical device.

DESCRIPTION OF PREFERRED EMBODIMENTS AND BEST MODE OF THE INVENTION

Figure 1:
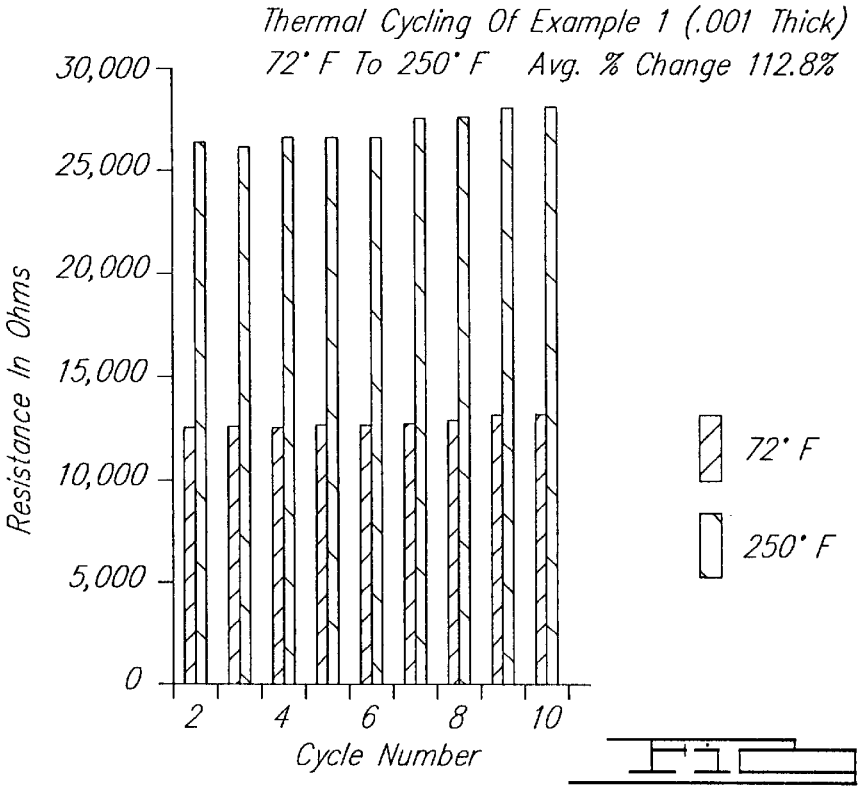
FIGS. 1–4 illustrate graphical representations of thermal cycling of PTC resistor compositions in accordance with the invention.
Figure 2:
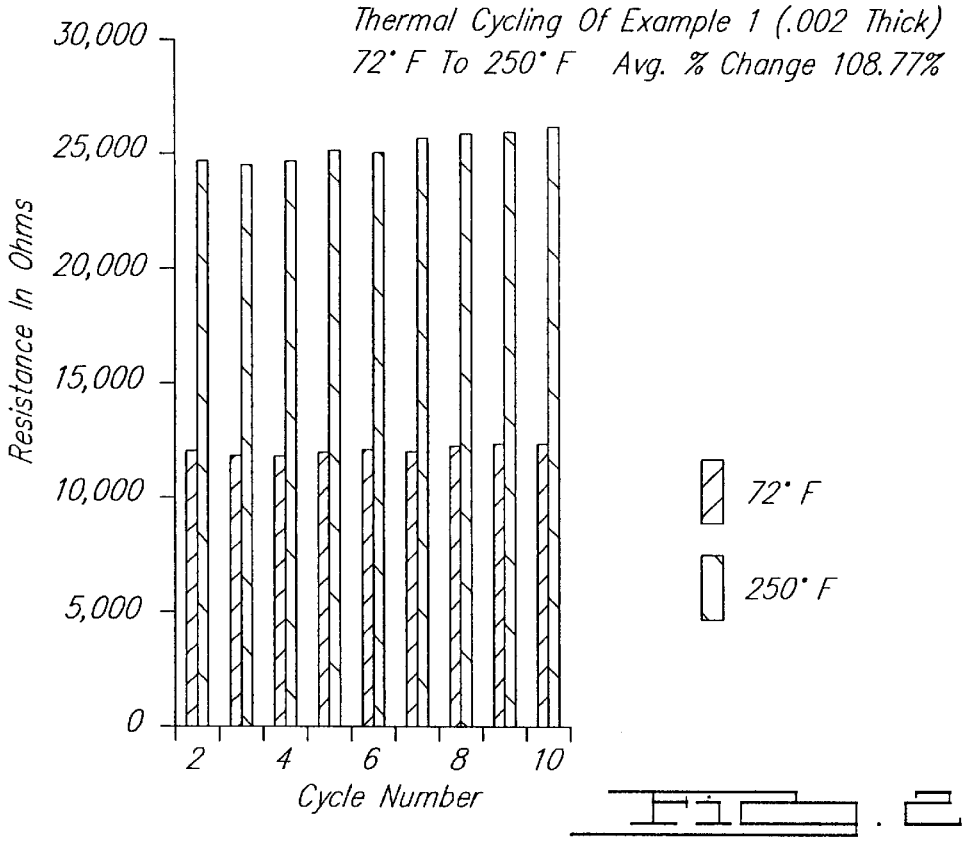
Figure 3:
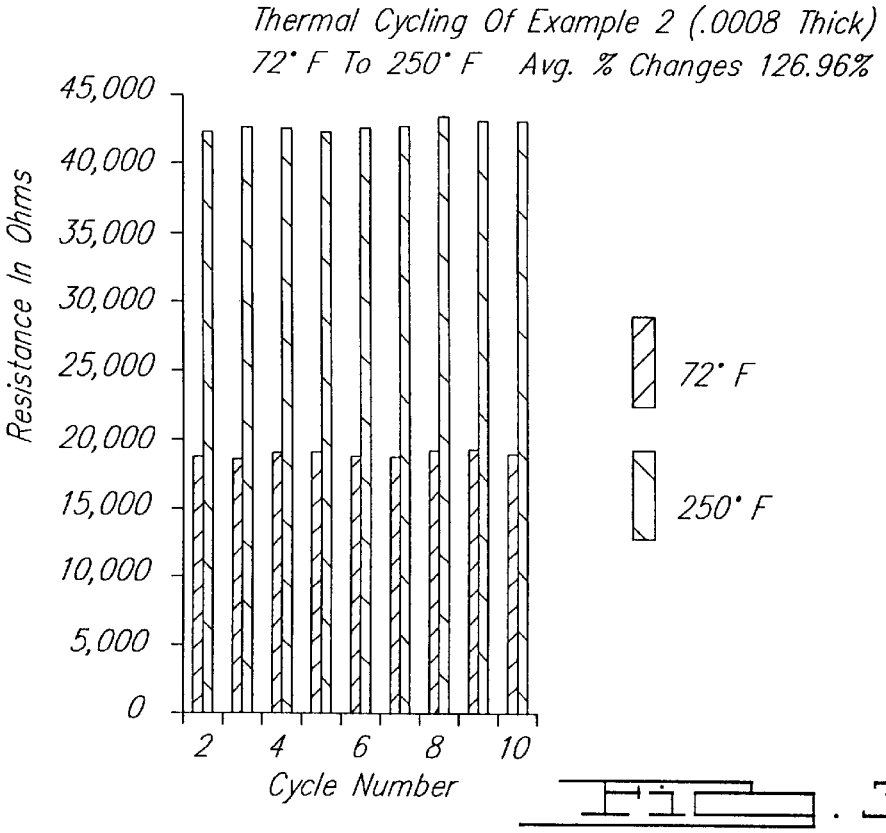
Figure 4:
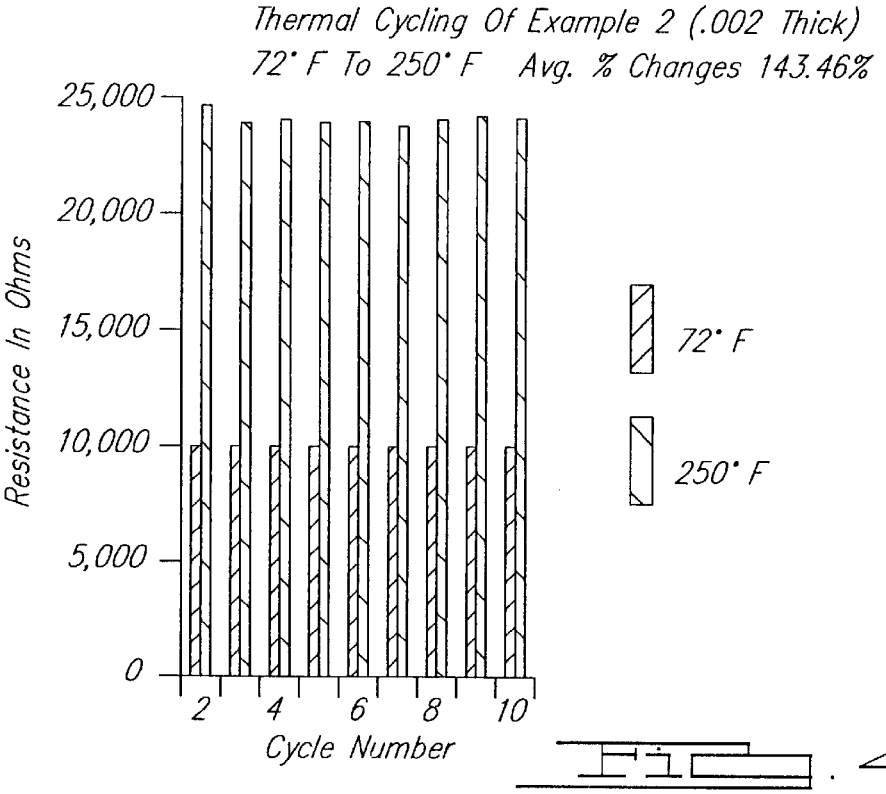
Figure 5:
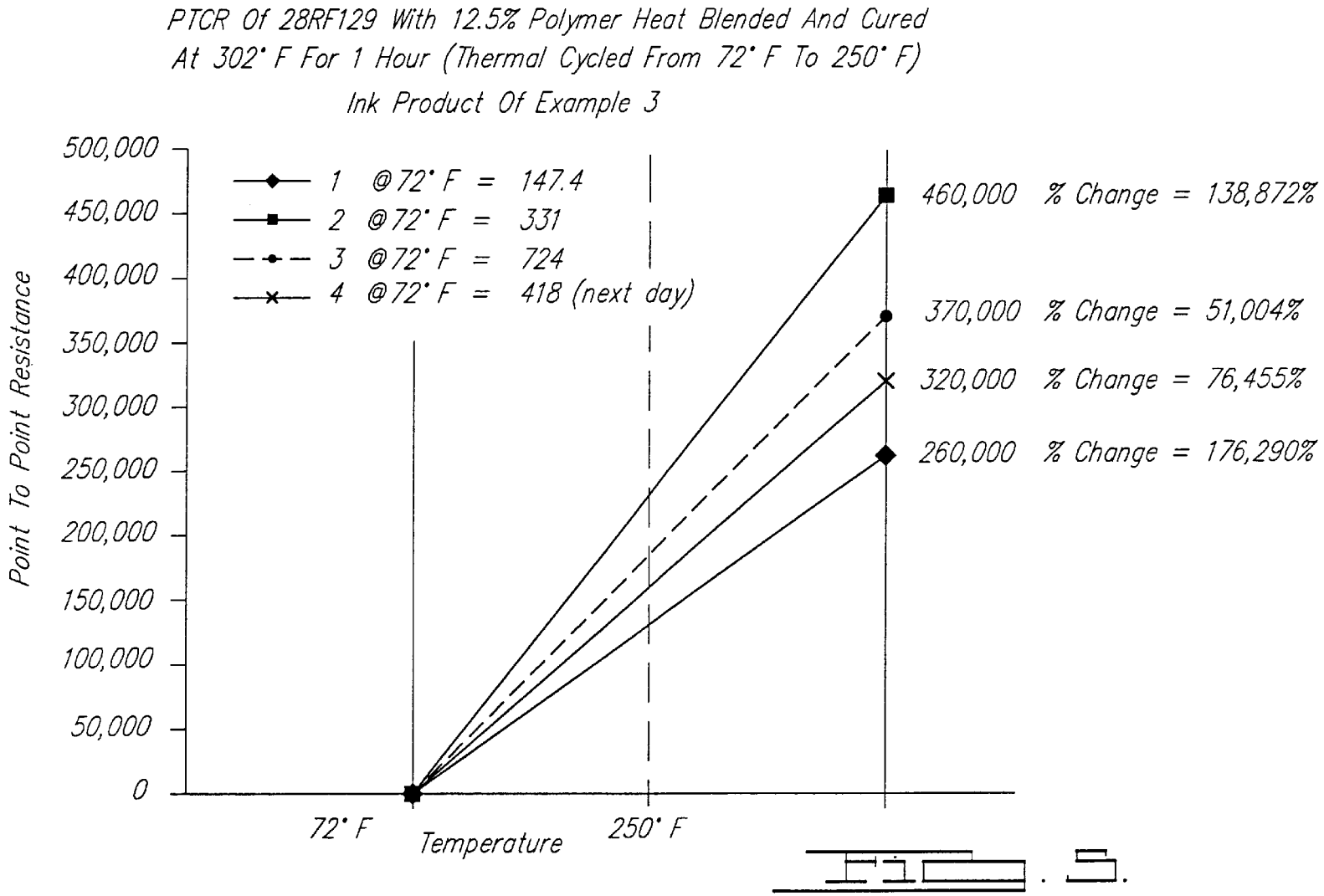
FIG. 5 illustrates a graphical representation of thermal cycling of the Example 3 PTC ink composition in accordance with the invention.

The present invention involves a unique new concept of mixing an insoluble semi-crystalline polymer into a PTF (polymer thick film) system. The PTF systems employed in this invention, for example, contain silver, nickel or carbon/graphite. It has also been discovered that other conductive fillers such as copper, silver coated copper, aluminum, or the like may also be used. The conductive fillers are used in finely divided or particulate form.

The preferred temperature activated semi-crystalline polymers which may be used in this invention are available from Landec Corporation (Menlo Park, Calif.) under the trade name of Intelimer®, although other semi-crystalline polymers can also be used as will be described hereinafter. These semi-crystalline polymers exhibit significant volume increases via phase transitions at certain temperatures, and they also utilize a special side-chain technology, which enables these polymers to have the unique capability of "off-on" control, i.e., a "temperature switch". These polymers are crystalline below the "temperature switch" and amorphous above it.

While the operation of the present invention is not fully understood, it has been discovered that the electrical resistivity of the positive temperature coefficient (PTC) composition significantly increases upon this transition, and then returns to its original value upon cooling. In order to assure that any large particles of the semi-crystalline polymer are broken up, mixtures prepared in accordance with this invention were either roll milled or heated so that the polymer liquefies to form an emulsion and then solidifies upon cooling into finer particles. The polymers used in this invention and in the following examples exhibit a sharp melt/flow point between about 30° to about 95° C., and preferably between about 60 to about 75° C., with best results being obtained using polymers with an activation point between about 63°–68° C.

By the term temperature activated semi-crystalline polymers as used in this invention it is meant a thermoplastic elastomer (TPE) polymer which melts at a relatively narrow and precise temperature range to thereby change from a crystalline state to an amorphous state. Such polymers are more specifically defined as a thermoplastic elastomer (TPE) comprising polymeric molecules which comprise (i) at least two polymeric A blocks, (a) each of the A blocks being crystalline and having a melting point $T_q$, and (b) at least one of the A blocks comprising a side chain comprising crystallizable moieties which render the block crystalline; and (ii) at least one polymer B block which (a) is linked to at least two A blocks, (b) is amorphous at temperatures at which the TPE exhibits elastomeric behavior, (c) has a glass transition point $T_{gs}$ which is less than $(T_q-10)$° C., and (d) is selected from the group consisting of polyethers, polyacrylates, polyamides, polyurethanes and polysiloxanes. These polymers are also more specifically described in Bitler et al. U.S. Pat. No. 5,665,822 (the disclosure of which is incorporated herein by reference); and such polymers are commercially available from Landec Corporation, Menlo Park, Calif.

In order to further illustrate the present invention, the following examples are provided. It is to be understood, however, that the examples are included for illustrative purposes and are not intended to be limiting of the scope of the invention as set forth herein.

EXAMPLE 1 (052A)

70 pbw ELECTRODAG® 440A—this is a highly conductive screen printable polymer thick film material. It contains conductive graphite dispersed in a vinyl polymer. 440A is available from Acheson Colloids Co, Port Huron, Mich. U.S.A.

30 pbw Landec Intelimer® 1000 Series semi-crystalline polymer.

Procedure: materials were mixed together in a Cowles mixer, DBE solvent added and then roll-milled until polymer is dispersed. Additional solvent was added to obtain a screen-printable viscosity. [Intelimer® is a registered mark of Landec Corporation].

EXAMPLE 2 (059)

70 pbw ELECTRODAG® 440A 30 pbw Landec Intelimer® 1000 Series polymer

Procedure: materials were blended together, heated in an oven at 107° C. and the mixed for 5 minutes. After cooling to room temperature, solvent was added to obtain a roll-millable viscosity and then the mixture was roll milled. Solvent was added to obtain a screen-printable viscosity.

EXAMPLE 3 (058)

87.5 pbw ELECTRODAG® 28RF129—silver filled thermosetting polymer thick film. ELECTRODAG®28RF129 is available from Acheson Colloids Co. it is made of a modified phenolic polymer (approximately 30–35% weight), about 65% weight silver particles, and a small amount of flow control agent.

12.5 pbw Landec Intelimer® 1000 Series polymer

Procedure: materials were blended together, heated in an oven at 107° C. and the mixed for 5 minutes. After cooling to room temperature, solvent was added to obtain a roll-millable viscosity and then the mixture was roll milled. Solvent was added to obtain a screen-printable viscosity.

EXAMPLE 4 (059A)

87.5 pbw of a nickel based polymer thick film ink, Product No. SS-24711, available from Acheson Colloids Co. See following Example 5.

12.5 pbw Landec Intelimer® 1000 Series polymer

Procedure: materials were blended together, heated in an oven at 107° C. and the mixed for 5 minutes. After cooling to room temperature, solvent was added to obtain a roll-millable viscosity and then the mixture was roll milled. Solvent was added to obtain a screen-printable viscosity.

EXAMPLE 5—PTF Ink (SS-24711 used in Ex. 4)

| | |
|---|---|
| Polyester resin (30% solids in solvent) (thermoplastic binder) | 38.5 |
| Carbitol Acetate | 8.6 |
| Bentone thickener (Rheological additive) | 1.8 |
| Colloidal Silica | 3.1 |
| Nickel flake — | 48.0 |
| (In form of finely divided particles) | 100.00 pbw |

The compositions of Examples 1–4 noted above were screen printed onto either Kapton or Mylar, and then cured at 150° C. for 30 minutes. The type of substrate and curing conditions were not critical for the purposes of this testing.

Volt meter probes were then attached to the ends of the printed strips which were ½ inch by 5½ inch dimensions; and, these strips were then placed on a hot plate and resistance changes were recorded over various temperatures.

Results

Initial room temperature, and high temperature resistivities, as well as percent changes are shown in the following tables. As a comparison, Acheson ELECTRODAG® 440A Product point-to-point initial resistance is 399 ohms and the resistance at 250° F. is 464 ohms (16.29% change). With Acheson Product No. 28RF129 (commercially available from Acheson Colloids Co.), initial point-to-point resistance is 1.46, and at 250° F. resistance is 1.72 (17.8% change).

Table Of Results

Ex. 4: 059A (SS24711-87.5%, Landec 12.5%)

| Temperature | 72 ° | 250 ° | % change |
|---|---|---|---|
| Resistance (ohms) | 3,390 | 840,000 | 24,678 |
| Ohms/sq/mil | 491 | 106,909 | 24,704 |

Ex. 2: (059) (440A-70%, Landec-30%)

| Temperature | 72 ° | 250 ° | % change |
|---|---|---|---|
| Resistance (ohms) | 9,877 | 24,055 | 143 |
| Ohms/sq/mil | 1,795 | 4,373 | 143 |

Controls (440A, 28RF129)

| | 72 ° F. | 250 ° F. | % change |
|---|---|---|---|
| 28RF129 | 1.46 | 1.27 | 17.8 |
| 440A | 399 | 464 | 16.29 |

Reversibility of the resistivity was also determined by cycling each print between room temperature and 250° F. As shown in the graphs of FIGS. 1–5, the graphite based materials after the first cycle displayed more of a capability of quickly returning to the original resistance. Silver and nickel based systems exhibited more of a delay in returning to original resistance.

In actual practice all of these materials could be over coated with a protective coating such as a UV curable dielectric coating material.

Added Description Of The PTC Composition Development

The Example 2 graphite PTC ink showed definite switching properties and good repeatability/recoverability, and it had about a 75–100% rise in resistance upon activation. Also noted with the Example 2 composition was a moderate degree of sloping (natural PTC of the ink) within the low resistance, non-activated and high resistance, activated regions. The Example 4 nickel ink composition showed a very large PTC effect, however it had high hysteresis, taking several hours or even days to recover to the original resistance value. Also the degree of hysteresis was dependent on the highest exposure temperature as well as the heating and cooling rates.

For purposes of providing a further improvement in the response of the PTC inks, it was decided to modify the binding resins and conductive pigments so as to maximize the effect seen from the expansion of the Landec polymers (e.g., the Landec thermoplastic elastomer polymers) upon activation. It was thought that the use of a highly compliant binder would provide the Landec polymers with enhanced freedom for expansion. This is believed to allow for increased separation of the conductive pigments which results in larger increases in resistance. The compliant resin also allows the pigments to more easily return to their original position upon cooling and contraction of the thermoplastic elastomer polymers, and hence reduce the hysteresis seen with earlier inks. Furthermore, it is believed that the use of a highly compliant binder better stabilizes the Landec polymers and decreases the tendency for the non-miscible Landec resin to migrate away from the base binding resin and self-coalesce. In total, it is believed that the PTC effect is maximized through the use of an elastomeric type resin material to essentially encapsulate the Landec polymer and conductive pigments in a rubbery, freely expanding and contracting mass.

Flexible Elastomer Binder Resins

The concept of this invention of using a highly compliant resin (or flexible elastic binder resin) as the binder for the PTC ink is applicable to a wide range of materials from simple solvent based thermoplastics to reactive elastomeric systems (thermosets, urethanes, UV or thermally cured acrylates, etc.). For this development, it was preferred to use thermoplastic resins, however it is also considered, broadly stated, that reactive urethane resins or acrylate resins also would be useable (i.e. thermosetting resins).

In the later examples of this disclosure the Landec polymers are utilized at lower levels than used in example 1–4. The examples 1–4 compositions were prepared by adding Landec polymers to previously prepared formulations. In that approach, a high level of Landec polymer was required for proper temperature functioning, with most systems needing about 10–20% (by weight) of Landec polymers to achieve reliable "switching". However, the high level of Landec polymer matched or exceeded the amount of the binder polymer in the ink which often resulted in improper cohesion and noticeable migration and coalescence of the melted Landec polymer. It was considered that a compliant resin would enhance the switching properties enough so that the Landec polymer level could be reduced substantially. This also has the benefit of reducing the tendency for migration due to the reduced amount of Landec polymer present in the system. Along with reducing the Landec, there was formulated a new ink composition with a reduced pigment level, so as to maximize the Landec polymer influence, while maintaining a relatively high binder content for good film properties.

Further examinations were made using various thermoplastic binder resins which would have suitable elastomeric-type properties. The Applicants examined the melt performance of various resins along with their film properties when dried from solvent solutions. Best results were obtained with the flexible urethane resins from B.F. Goodrich Co. sold under their trade name Estane®. As a result of this study, it was discovered that Estane 5703, in particular, yields a film with extremely good flexibility and toughness. This resin could produce a suitably elastomeric film when dried from a "cut" of resin in MEK @ 20% solids, or it could produce a film with similar properties and good uniformity when the dried resin granules were raised to reflow temperatures and melted into a resinous sheet (or cast into a thicker slug). Other urethanes such as Estane 5706, 5712, and 5715P, along with the CA239 urethane from Morthane Co., were examined, and are considered workable in this invention.

The first step in ink preparation was to prepare resin cuts of the Estane 5703 in slow evaporating solvents suitable for screen print use. It was discovered that the 5703 resin had unsatisfactory solubility in many of the commonly used screen print solvents, with lowest usable viscosities being achieved in gammabutyrolactone (BLO) and N-methylpyrrolidone (NMP) from ISP Co., and Diethylene Glycol Monoethyl Ether Acetate (Carbitol Acetate) and Diacetone Alcohol from Ashland Co. The lowest viscosity resin cut was achieved using Diacetone Alcohol ("DiAcOH").

EXAMPLE 6

A resin cut of 25% Estane 5703 in DiAcOH was prepared, and a nickel based ink was formulated using Novamet type CHT flake and Landec 65° C. Intelimer polymer. The Landec p/b ratios (pigment to binder ratio) was set at 0.75 while the nickel p/b was at 2.5. These represented lowered p/b for both elements as compared to the Example 4 nickel ink. Ink NV solids were 55% in the formulation below:

| | | |
|---|---|---|
| Ink Product No. 76055: | Estane 5703 (High compliance binder material) | 12.94 |
| | Diacetone Alcohol (Solvent) | 45.00 |
| | Nickel type CHT (Finely divided nickel particles) | 32.35 |
| | Landec 65 ° C. Polymer | 9.71 |
| | (Intelimer polymer) | 100.00% wgt. |

The ingredients were hand mixed until uniform and then passed over a three roll mill for two passes. At that point some apparent drying on the mill was seen and it was noted that DiAcOH would probably be too fast for many screen print applications. The amount of drying was also questionable, possibly due to an incompatibility of the Landec polymer in this particular ink composition. Accordingly, there was a certain amount of de-wetting of the Landec polymer. The ink appeared to be prematurely drying, even though it was not.

The Example 6 ink composition was compared with a commercially available 65–70° C. PTC ink (i.e., a prior art PTC ink known as Raychem SRM ink, from Raychem Corp. of Menlo Park, Calif.) printed onto an etched copper substrate. Due to the presence in some circumstances of unsatisfactory screen printing performance and drying behavior with the Applicants' previous Landec based inks, it was decided to draw down a wet film of the Example 6 ink over an etched copper substrate, rather than to screen print it. A 2"×4" pattern, approximately 5 mils thick, was drawn down over the etched copper and dried for 10 minutes at 107° C.

Due to the pattern shape and substrate, the normalized resistivity was not calculated. Rather, the point to point resistance was measured as the circuit was heated from −20° C. to 100° C.; and the PTC effect was observed through the relative change of the entire circuit resistance. The Example 6 was compared against Applicant's Example 2 ink, and the commercial (Raychem) PTC ink applied to the same substrate. The PTC behavior of the Example 6 ink was noted to occur rapidly near the "switch" activation temperature of the Landec polymer, i.e., approximately 65° C. Upon activation, a large change in resistance was seen, with the resistance above the activation temperature remaining relatively constant.

The performance of the Example 6 ink was found to have markedly superior performance to the commercial (Raychem) PTC ink. The Example 6 ink provided much larger changes in resistance and a much sharper transition point on the activation curve.

The Example 2 ink gave approximately 100% increase in resistance, changing from 30–35 ohms to 65–70 ohms, while the commercial PTC ink (Raychem) produced a 1300% increase, changing from less than 25 ohms to 350 ohms. The Example 6 ink, however, was found to change from less than 10 ohms to over 2.5 Megohms, a 25,000,000% increase, an extremely significant and unexpected technical advance. [A Megohm equals 1 million ohms].

Figure 6:
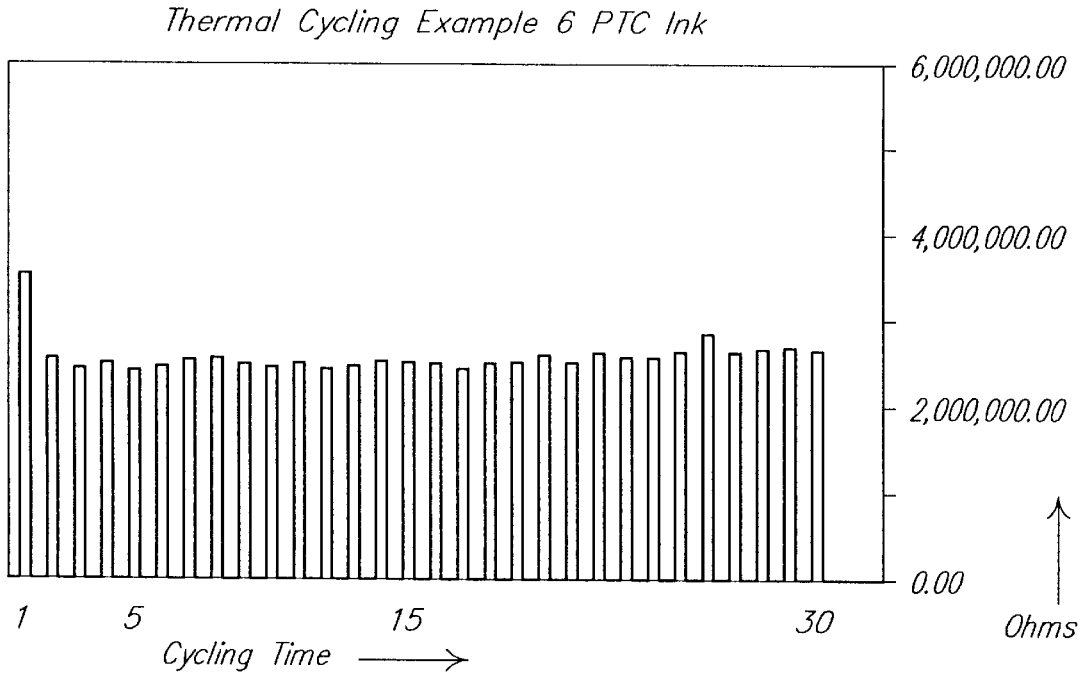
FIG. 6 illustrates a graphical representation of thermal cycling of the Example 6 PTC ink composition in accordance with the invention.

To study the long term properties, the test was repeated with the Example 6 ink by repeatedly cycling the print from −20° C. to 100° C. and plotting the resulting resistance (see FIG. 6 plotted graph). The test continued for 30 full cycles at which time the material displayed excellent stability with essentially no hysteresis, while retaining the sharp "on-off" activation. The print showed slightly higher "activated" resistance of approximately 3.5 Megohms on the first cycle, then fell to and maintained approximately 2.5 Megohms for the remainder of the test. Overall change for the Example 6 ink system was at least a 25,000,000% increase in resistance upon heating and activation of the PTC ink system. Following the thermal cycling, the print surface was observed to have taken on a somewhat irregular surface, as would be seen if the wet print layer had contained a small amount of bubbles. The wet and initially dried print surface did not show this appearance. The cycled print continued to show good adhesion and cohesion in light of the Estane's naturally soft surface.

With the success of the Example 6 formulation, a further examination was made of the screen print characteristics. The focus was directed to switching the ink system to an even better solvent for screen print application, and also, to improving the compatibility of the TPE polymer (e.g., the Landec Intelimer polymer).

From earlier solvency work, it was determined that another solvent suitable for use with the given Estane 5703 polymer was Diethylene Glycol Monoethyl Ether Acetate [Carbitol DE Acetate]. This solvent had been previously used with Applicant's PTF inks, and it was found to provide much longer screen residency times, and ease of handling, as compared to the faster Diacetone Alcohol ("DiAcOH"). However, the viscosity of Estane 5703 in Carbitol DE Acetate ("DE Acetate") is somewhat higher than that of DiAcOH, which required a lower solids ink for final use.

EXAMPLE 7

A resin cut of 20% Estane 5703 in DE Acetate was prepared, and a nickel based ink was prepared using Novamet type CHT nickel flake and Landec 65° C. Intelimer polymer. The Landec p/b was maintained at 0.75 while the nickel p/b was at 2.5. Solids in this version were 51.5% as compared to the earlier 55% of Example 6.

| | | |
|---|---|---|
| Ink product No. 76056: | Estane 57O3 | 12.12 |
| | DE Acetate (Solvent) | 48.49 |
| | Novamet Nickel type CHT flake | 30.30 |
| | Landec 65 ° C. polymer | 9.09 |
| | | 100.00% wgt. |

The ingredients were hand mixed until uniform and were observed to have a "hazy" sheen. The material was passed over a three roll mill for two passes with no significant drying seen, and the ink maintained a somewhat paste-like character.

Experiments were conducted to print the ink of Example 7 with a 100 mesh polyester screen using an open 2.5"×6" pattern, but this did not provide as good of printing behavior as desired. The dried ink appeared to be somewhat resin rich, with not enough nickel pigment being deposited through the screen. Further printing was then carried out with samples containing extra solvent, Modaflow [an acrylic flow agent; available from Monsanto Chemical Co.] or Care 16 (silicone oil flow agent). The Care 16 silicone demonstrated improvement in terms of print smoothness and increased film density. (See the following example).

EXAMPLE 8

In this example a formulation was prepared with Care 16 (silicone oil flow agent) and the pigment content was raised for purposes of increasing the pigment density and fill of the printed pattern. The Landec p/b was raised to 0.8 and the nickel p/b to 3.5. Solids of this version were at 55%.

| | | |
|---|---|---|
| Ink Product No. 76057: | Estane 5703 | 10.28 |
| | DE Acetate (solvent) | 45.00 |
| | Nickel type CHT | 36.00 |
| | Landec 65 ° C. polymer | 8.22 |
| | Care 16 | 0.50 |
| | (silicone flow agent) [Available from Nazdar Co.] | 100.00% wgt. |

The ink was prepared and milled as in Examples 6–7, with the final ink having an appearance similar to the earlier systems. The ink was printed using a 100 mesh polyester screen with an open 2.5"×6" pattern. The print surface was improved with the silicone addition, now giving a much smoother appearance, though the print was still somewhat insufficient in pigment content. The CHT nickel flake used was much finer than the Novamet HCA-1 applicants used in other conductive PTF inks. Circuits were also made with additional print layers.

EXAMPLE 9

A quantity of the larger HCA-1 finely divided nickel was added to the wet ink (of Example 8) for the purpose of filling gaps and to serve as a bridge to connect the smaller CHT particles. The nickel was added and milled as in Examples 6–8, followed by the addition of DE Acetate to maintain 55% solids. This resulted in the following formulation:

| | | |
|---|---|---|
| Ink Product No. 76058: | Estane 5703 | 7.75 |
| | DE Acetate (solvent) | 45.00 |
| | Nickel type CHT | 27.12 |
| | Nickel HCA-1 (finely divided nickel) | 13.56 |
| | Landec 65 ° C. polymer | 6.19 |
| | Care 16 | 0.38 |
| | | 100.00% wgt. |

The above ink was screen printed and dried as before (i.e., see Examples 7–8), and yielded good print qualities. A good conductive print was achieved with three complete print passes. Tests were then carried out on a complete screen printed PTC ink package.

Figure 7:
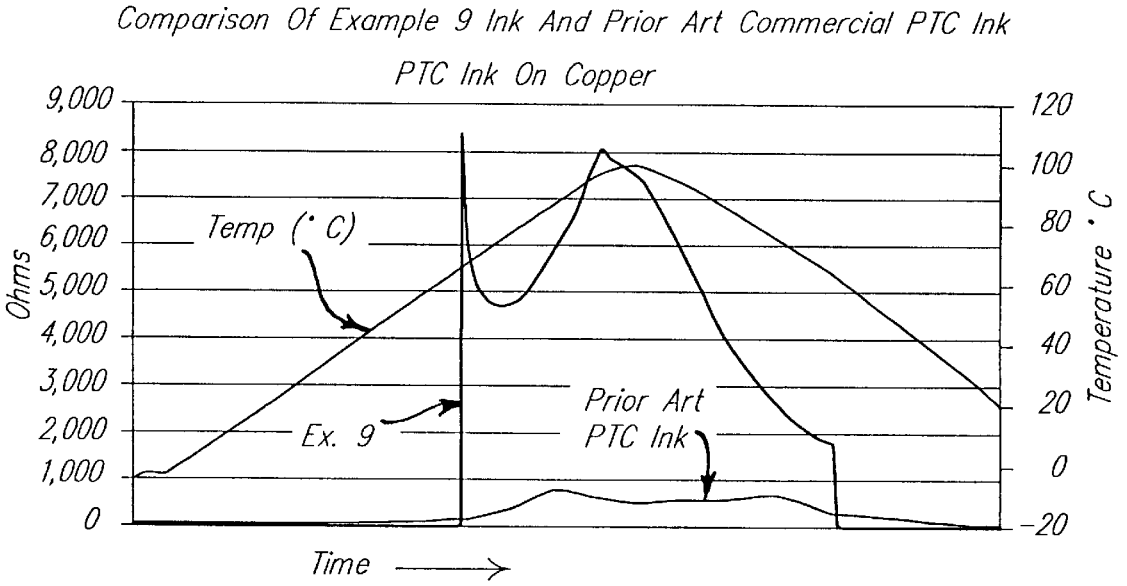
FIG. 7 illustrates a graphical plot comparing the Example 9 PTC ink product of the invention with a commercially available PTC ink.

The Example 9 ink was printed in two different configurations for testing. The first method was to manually draw the ink down onto the etched copper panel for comparison with the commercial (Raychem) PTC ink as done previously. This method yielded a smooth print over the copper, with no apparent bubbles, and none of the surface shininess associated with earlier resin-rich systems. A single thermal cycle was performed with this system, with the test being conducted alongside the commercial (Raychem) ink as the control. Response of the Example 9 ink was once again uniquely better than that of the commercial ink, giving a much larger change in overall resistance and a more defined activation profile (see the FIG. 7 plotted graph). The ink of Example 9 essentially remained at a constant resistance until activation, at which time it responded rapidly with very little delay in resistance rise. Initial resistance of the circuit was 5 ohms, rising to over 8,000 ohms upon initial activation. Further heating resulted in a slightly different profile, rising once again to 8000 ohms at maximum heating. The test circuit always remained above 1700 ohms when activated though in this construction it did appear to have definite PTCR above the activation point. The comparison commercial (Raychem) PTC ink gave its expected performance, without a sharp activation profile as seen with the inks of this invention.

The second test method was for an actual screen printed construction, printing three separate additive layers of the Example 9 ink, and then applying a highly conductive, interdigitated buss bar using Acheson Colloids Co. 725A silver PTF ink (this ink is available under the trade name ELECTRODAG® 725A from Acheson Colloids Co.). Spacing of the buss bar legs was 0.4" across the width of the 2.5×6" PTC ink pattern. Three PTC circuits were constructed in this manner and thermal cycled through 8 complete, −20 to 100° C. cycles. The initial resistance of all circuits was less than 50 ohms. Upon activation, all three circuits rose drastically in resistance to over 50 Megohms, and often exceeded the 120 megohm maximum value of the instrument as the temperature was raised above 65° C. activation temperature. All test circuits returned to less than 100 ohms upon cooling for the duration of the cycling test. The above tests establish the significant technical advance and unexpected results achieved with the products of this invention.

Figure 8:
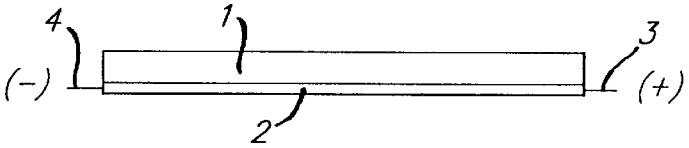
FIG. 8 illustrates an electrical device prepared in accordance with the invention.

FIG. 8 illustrates an electrical device (in schematic fashion) made in accordance with the invention. The FIG. 8 device includes a rear view mirror 1 which includes a PTC ink conductive coating 2 on the back side of the mirror, with the ink coating being formulated in accordance with the invention. Electrical circuit connections are made to the coating 2 by use of the connector leads designated 3 and 4 (i.e., providing a technique of heating the back side of an automotive exterior rear view mirror for defogging purposes. As will be appreciated after reading the above inventive disclosure, the PTC ink or coating materials in accordance with this invention could also be used in applications such as, refrigerator door heaters, deicing heaters, baby bottle heaters, for rechargeable battery protection, for thermistor (sensing preset temperatures), for printed fuses and resettable fuses, for process heaters, for printed circuits, and many more such applications.

The binder resin used in the invention should be present in the PTC resistor composition within the broad range of about 3% to about 75% by weight of the composition, and preferably within the range of about 4% to about 60% by weight, with best results being obtained when the binder resin is present within the range of about 5% to 10% by weight of the composition. The binder resin is preferably a thermoplastic binder resin selected from the group consisting of a urethane resin, a vinyl resin, and an acrylic resin, a phenoxy resin, or a polyester resin. However, broadly stated, the binder resin may also be selected from the same group of resins just mentioned but being of the thermosetting type.

The temperature activatable semi-crystalline polymer, which is a thermoplastic elastomer (TPE), should broadly be present in the PTC resistor composition within the range of about 0.5% to 70% by weight, in certain instances 2% to 70%, preferably within the range of about 4% to about 45% by weight, with best results being obtained when this polymer is present within the range of about 6% to about 10% by weight of the composition. This temperature activatable semi-crystalline polymer is a different polymer than that used for the binder resin, and is mutually exclusive with respect thereto.

The electrically conductive material in finely particulated form, should broadly be present in the PTC resistor composition within the range of about 10% to 80% by weight, and preferably within the range of about 20% to about 70% by weight, with best results being obtained when this conductive material is present within the range of about 25% to about 45% by weight of the composition.

The solvent material used in connection with the resistor composition, and/or applied ink coatings made with said resistor composition, should broadly be present within the range of about 0.01% to about 80% by weight of the composition, and preferably within the range of about 0.5% to about 75% by weight, with more preferred results being obtained when the solvent is present within the range of about 8% to about 50% by weight of the composition, and best results at 30% –50% by weight of the composition. It should also be understood that when the PTC resistor composition is applied as a coating or as an ink to a substrate, for purposes of forming an electrical device, the solvent may remain present in only trace amounts within the applied ink or the applied coating; and accordingly, by the lower limit of 0.01% by weight it is meant to include only trace amounts of said solvent which would remain in the composition after the same is applied as a coating or as an ink to some substrate. The substrates on which the resistor composition is applied or used may be of flexible, semi-flexible or rigid form.

The additive materials which are used in the inventive composition are present anywhere from about 0 to about 15% by weight of the PTC resistor composition, and preferably are present within the range of about 0.01% to about 12% by weight of the composition, with even more improved results being obtained when such additive material or materials are present within the range of about 1% to about 10% by weight of the composition. The additive materials useable in the invention are selected from at least one member of the group consisting of a flow agent, a dispersing agent, a wetting agent, a viscosity control agent, or a rheological agent.

While it will be apparent that the preferred embodiments of the invention disclosed above are well calculated to fulfill the objects, benefits and advantages of the invention, it will be appreciated that the invention is susceptible to modification, variation and change without departing from the proper scope or fair meaning of the subjoined claims.

What is claimed is:

1. A positive temperature coefficient (PTC) resistor composition, comprising:

(a) about 3% to about 75% by weight of a binder resin, (b) about 0.5% to about 70% by weight of a temperature activatable semicrystalline polymer, which is a thermoplastic elastomer (TPE) that melts at a relatively narrow temperature range to change from a crystalline state to an amorphous state, (c) about 10% to about 80% by weight of an electrically conductive material in finely particulated form selected from the group consisting of silver, graphite, graphite/carbon, nickel, copper, silver coated copper, and aluminum, (d) about 0.01% to about 80% by weight of solvent material for the composition.

2. The invention of claim 1 wherein, in weight percent, part (a) is about 4% to about 60%, part (b) is about 4% to about 45%, part (c) is about 20% to about 70%, part (d) is about 0.5% to about 75%.

3. The invention of claim 1 wherein, in weight percent, part (a) is about 5% to about 10%, part (b) is about 6% to about 10%, part (c) is about 25% to about 45%, part (d) is about 30% to about 50%.

4. The invention of claim 1 wherein, in weight percent, said composition also includes, zero to about 15% by weight of an additive material selected from at least one member of the group consisting of a flow control agent, a dispersing agent, a wetting agent, a viscosity control agent, and a rheological agent.

5. The invention of claim 1 wherein, in weight percent, said composition also includes, about 0.01% to about 12% by weight of an additive material selected from at least one member of the group consisting of a flow control agent, a dispersing agent, a wetting agent, a viscosity control agent, and a theological agent.

6. The invention of claim 3 wherein, in weight percent, said composition also includes, about 0.01% to about 12% by weight of an additive material selected from at least one member of the group consisting of a flow control agent, a dispersing agent, a wetting agent, a viscosity control agent, and a rheological agent.

7. An electrical device made from a PTC resistor composition, comprised of, (a) about 3% to about 75% by weight of a binder resin, (b) about 0.5% to about 70% by weight of a temperature activatable semicrystalline polymer, which is a thermoplastic elastomer (TPE) that melts at a relatively narrow temperature range to change from a crystalline state to an amorphous state, (c) about 10% to about 80% by weight of an electrically conductive material in finely particulated form selected from the group consisting of silver, graphite, graphite/carbon, nickel, copper, silver coated copper, and aluminum, (d) about 0.01% to about 80% by weight of solvent material for the composition, and wherein said PTC resistor composition is applied to at least one substrate surface within said electrical device, and said device includes at least one electrical circuit for conducting electricity within said device.

8. The invention of claim 7 wherein, part (a) is about 4% to about 60%, part (b) is about 4% to about 45%, part (c) is about 20% to about 70%, part (d) is about 0.5% to about 75%.

9. The invention of claim 7 wherein, part (a) is about 5% to about 10%, part (b) is about 6% to about 10%, part (c) is about 25% to about 45%, part (d) is about 30% to about 50%.

10. The invention of claim 7 wherein, said composition also includes, zero to about 15% by weight of an additive material selected from at least one member of the group consisting of a flow control agent, a dispersing agent, a wetting agent, a viscosity control agent, and a rheological agent.

11. The invention of claim 7 wherein, said composition also includes, about 0.01% to about 12% by weight of an additive material selected from at least one member of the group consisting of a flow control agent, a dispersing agent, a wetting agent, a viscosity control agent, and a theological agent.

12. The invention of claim 9 wherein, said composition also includes, about 0.01% to about 12% by weight of an additive material selected from at least one member of the group consisting of a flow control agent, a dispersing agent, a wetting agent, a viscosity control agent, and a rheological agent.

13. A method of manufacturing an electrical device comprising the steps of, (1) providing a PTC resistor composition comprised of, (a) about 3%) to about 75% by weight of a binder resin, (b) about 0.5% to about 70% by weight of a temperature activatable semicrystalline polymer, which is a thermoplastic elastomer (TPE) that melts at a relatively narrow temperature range to change from a crystalline state to an amorphous state, (c) about 10% to about 80% by weight of an electrically conductive material in finely particulated form selected from the group consisting of silver, graphite, graphite/carbon, nickel, copper, silver coated copper, and aluminum, (d) about 0.01% to about 80% by weight of solvent material for the composition, and (2) applying said PTC resistor composition to a substrate which is a part of said electrical device.

14. The invention of claim 13 wherein, part (a) is about 4% to about 60%, part (b) is about 4% to about 45%, part (c) is about 20% to about 70%, part (d) is about 0.5% to about 75%.

15. The invention of claim 13 wherein, part (a) is about 5% to about 10%, part (b) is about 6% to about 10%, part (c) is about 25% to about 45%, part (d) is about 30% to about 50%.

16. The invention of claim 13 wherein, said composition also includes, zero to about 15% by weight of an additive material selected from at least one member of the group consisting of a flow control agent, a dispersing agent, a wetting agent, a viscosity control agent, and a rheological agent.

17. The invention of claim 13 wherein, said composition also includes, about 0.01% to about 12% by weight of an additive material selected from at least one member of the group consisting of a flow control agent, a dispersing agent, a wetting agent, a viscosity control agent, and a rheological agent.

18. The invention of claim 15 wherein, said composition also includes, about 0.01% to about 12% by weight of an additive material selected from at least one member of the group consisting of a flow control agent, a dispersing agent, a wetting agent, a viscosity control agent, and a rheological agent.

* * * * *